United States Patent [19]

Grunert et al.

[11] 4,371,223

[45] Feb. 1, 1983

[54] CABINET DOOR HINGE

[75] Inventors: Hans C. Grunert, Aldelberg; Heinz Becker, Weinstadt, both of Fed. Rep. of Germany

[73] Assignee: Sybron Corporation, Rochester, N.Y.

[21] Appl. No.: 149,572

[22] Filed: May 14, 1980

[51] Int. Cl.[3] ..... A47B 95/00; E05D5/58

[52] U.S. Cl. ..... 312/325; 312/311; 16/364

[58] Field of Search ..... 312/325, 329, 311, 295; 16/178, 179

[56] References Cited

U.S. PATENT DOCUMENTS

| | | | |
|---|---|---|---|
| 2,648,583 | 8/1953 | Teach | 312/325 |
| 2,814,545 | 11/1957 | Cornish | 312/311 |
| 3,055,724 | 9/1962 | Mazure | 312/325 |
| 3,075,819 | 1/1963 | Liegeon et al. | 312/325 |
| 3,081,138 | 3/1963 | Stebbins | 312/325 |
| 3,399,940 | 9/1968 | Yang et al. | 312/325 |
| 3,575,483 | 4/1971 | Church | 312/325 |
| 4,076,351 | 2/1978 | Wyant | 312/325 |

FOREIGN PATENT DOCUMENTS

| | | | |
|---|---|---|---|
| 2506613 | 8/1976 | Fed. Rep. of Germany | 16/179 |
| 2646371 | 4/1978 | Fed. Rep. of Germany | 16/179 |

*Primary Examiner*—Victor N. Sakran

*Attorney, Agent, or Firm*—Theodore B. Roessel; Roger Aceto; Robert Gerlach

[57] ABSTRACT

Cabinet doors are supported by a hinge system that allows the doors to swing into an open space below the cabinet as they are opened. The hinge also reduces the room that must be provided in front of the cabinet to open the door. The door is mounted on hinge bars pivotally connected to a slide that rides on runners inside the cabinet. In the closed position, the bars rest on support pegs extending from the sides of the cabinet. As the door is moved forward, the hinge bars can pivot about the support pegs and the door can swing into the open space beneath the cabinet. Pivot pegs extend from each side of the cabinet in front of and below the support pegs, and the hinge bars contact the pivot pegs as the hinge bars pivot about the support pegs. The hinge bars then pivot about the pivot pegs, which control and limit the motion of the door as it moves into the fully open position.

4 Claims, 6 Drawing Figures

CABINET DOOR HINGE

BACKGROUND OF THE INVENTION

This invention relates to storage cabinets, and more particularly to a hinge system for doors to relatively deep drawers or storage areas.

Cabinets frequently include drawers or storage areas for relatively large instruments or similar pieces of equipment, such as dental scalers, gum treatment instruments and the like. Doors that can be stored out of the way when the drawer or storage area is opened are desirable. Also, doors that can be opened with minimal forward motion are preferred in some situations. For example, in modern dentistry, the dentist and his assistant usually sit beside the patient. Preferably, their instruments should be located close enough to be accessible without getting up. Doors that can be opened with a minimal amount of forward motion are desirable because the storage cabinets can be closer to the dentist or the dental assistant.

Prior art cabinets for this type of equipment frequently use doors that pivot at the top or bottom of the door and slide into the cabinet for storage. This gets the door out of the way, but it consumes some space within the cabinet. Also, these doors usually must be swung to a substantially horizontal position before they can slide into the cabinet. Thus, the free space in front of the cabinet must be at least equal to the height of the doors.

SUMMARY OF THE INVENTION

This invention provides a hinge system that allows a door to swing into an open space below the cabinet. It also minimizes the forward motion needed to open the door.

The hinge system of the invention includes runners mounted at each side of the cabinet, and one or more slides supported by and adapted to move back and forth within the cabinet on the runners. A hinge bar on each side of the cabinet is rigidly connected to the door and pivotally connected to the slide. In the closed position each hinge bar is supported by a peg extending from the side of the cabinet, or other suitable support. When the door is pulled forward, the hinge bar can pivot and the door can swing into an open space below the cabinet.

Preferably, the hinge system includes a pivot peg extending from each side of the cabinet in front of and below the support peg. The hinge bars contact the pivot pegs as the bars pivot about the support pegs. The bars then pivot about the pivot pegs as the door swings completely into the open space. The pivot pegs control the motion of the door during the latter part of its travel, and determine the final position of the door. Thus, the pivot pegs keep the door from contacting the shell of the cabinet, which helps preserve its appearance. The pivot pegs, by serving as fulcrums, also simplify moving the door to the fully open position.

DRAWINGS

DETAILED DESCRIPTION

Figure 1:
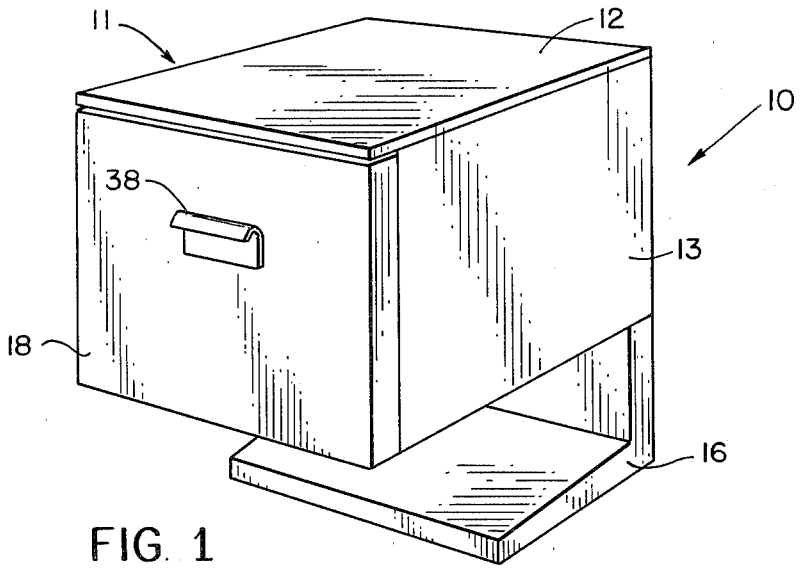
FIG. 1 is a perspective view of a storage cabinet embodying this invention.

The cabinet shown in the Figures includes a shell 11—comprising a top 12, sides 13, back 14 and bottom 15—mounted on a pedestal 16 to provide an open space 17 beneath the shell. A door 18, supported by the hinge system of this invention, closes the opening at the front of the shell. A handle 38 is mounted on the door so that the door can be pulled out from the cabinet.

Figure 2:
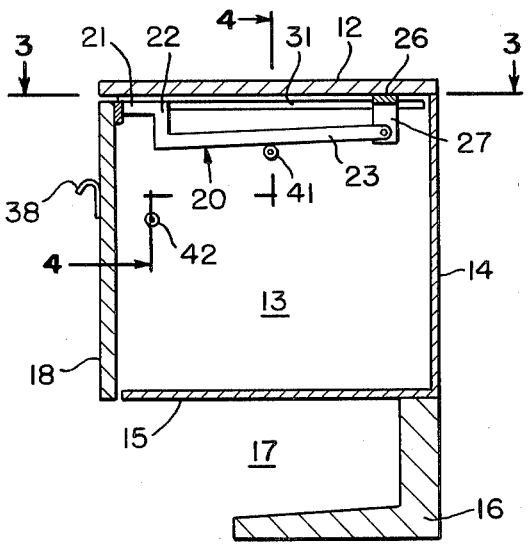
FIG. 2 is a cross-sectional right elevation of the cabinet in FIG. 1.
Figure 3:
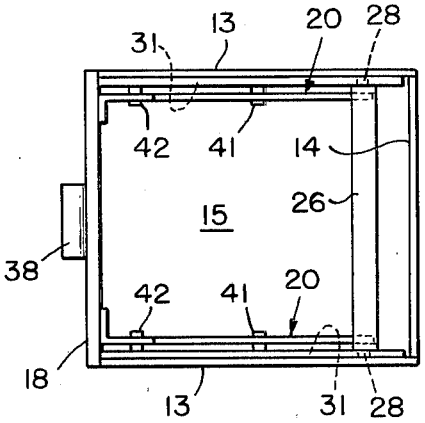
FIG. 3 is a cross-sectional plan view along lines 3—3 in FIG. 2.
Figure 4:
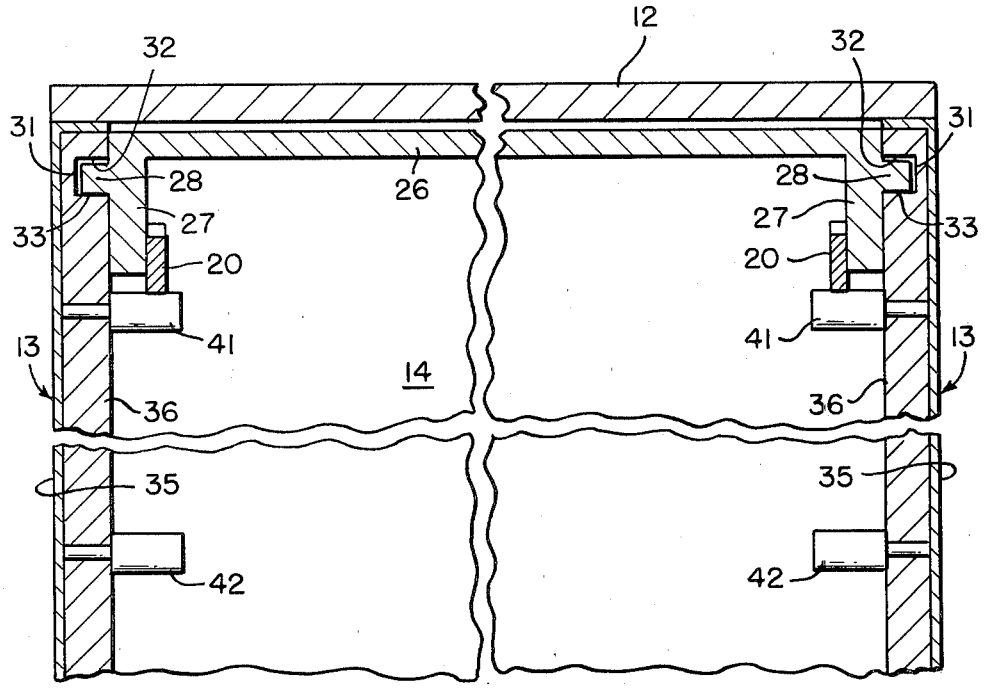
FIG. 4 is an enlarged cross-sectional front elevation view along lines 4—4 in FIG. 2.

As may be seen in FIGS. 2 and 3, the door 18 is supported by hinge bars 20. These bars are bolted, welded or otherwise rigidly connected to the door at either side of the cabinet. The rear ends of the hinge bars 20 are pivotally connected to lugs 27 depending from a slide 26. As best shown in FIG. 4, the ends 28 of slide 26 ride in grooves 31 at each side of the cabinet. The upper and lower edges of the grooves serve as top runners 32 and bottom runners 33 that support the slide and control its movement. Preferably, the slide extends across the entire width of the cabinet, as shown in FIG. 4. This simplifies construction of the slide and the wall grooves 31 because the center section of the slide holds the slide ends 28 in the grooves 31. Also, producing the slide as a unitary piece helps the hinge bars work in unison.

When the doors are closed, the hinge bars 20 rest on support pegs 41 extending from each side wall of the cabinet. When the doors open, the hinge bars slide along the support pegs 41 until the slide moves in front of the support pegs. As the slide 26 moves ahead of the support pegs 41, the hinge bars can pivot into contact with pivot pegs 42 mounted ahead of and below the support pegs. The pivot pegs control the movement of the door as it swings into the fully open position, which is shown in FIG. 6.

The front ends of the grooves 31 in the side of the cabinet are closed. The closed front ends of the grooves and the pivot pegs 42 limit the opening movement of the door, and keep the door and hinge bars from contacting the cabinet bottom 15 and/or the support pedestal 16. This preserves the appearance of the cabinet. Preferably, the support pegs 41 and pivot pegs 42 are positioned so that the door will swing just beneath the bottom 15 of the cabinet shell 11 as the door moves into the open space 17 beneath the shell.

The pivot pegs 42 also act as fulcrums that simplify opening of the door. When the hinge bars 20 have pivoted into contact with the pivot pegs 42, the door can be opened the remainder of the way by simply pressing down and back on the handle 38. This produces a moment—about the pivot pegs 42—that moves the slide 26 forward in grooves 31, allowing the door to swing into the fully opened position shown in FIG. 6.

Figure 5:
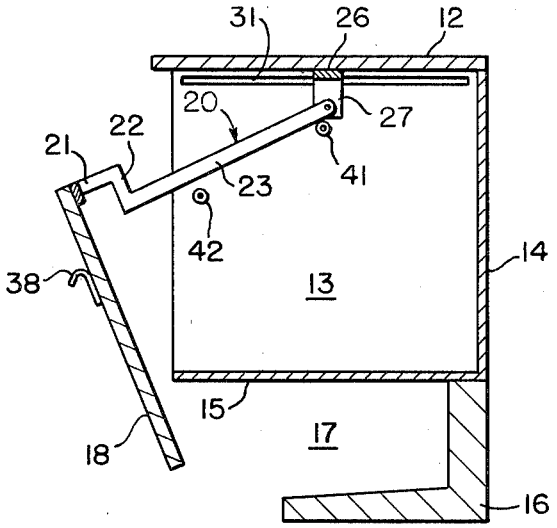
FIGS. 5 and 6 are cross-sectional right elevation views, from the same vantage point as FIG. 2, showing the cabinet door in the partially opened and fully opened position.
Figure 6:
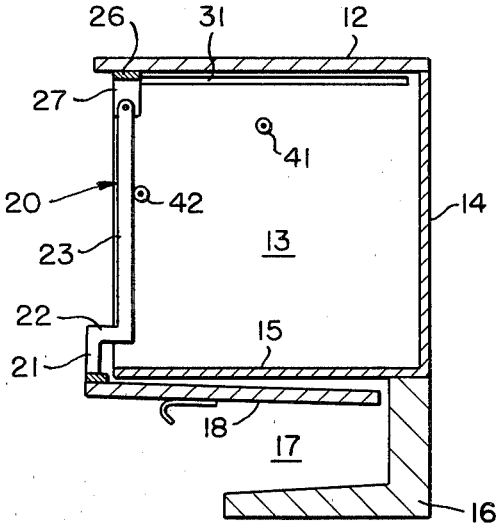

As may be seen in FIGS. 2, 5 and 6, the preferred hinge bar has a short, substantially horizontal section 21 attached to and extending to the rear of the door, a second section 22 extending down from the front horizontal section 21, and a third section 23 extending from the vertical section 22 to the slide 26. As may be seen in FIG. 6, this keeps most of the hinge bar inside the cabinet in the open position.

The rear sections 23 of the hinge bars 20 may be substantially horizontal or, as may be seen in FIG. 2, may be inclined so that the parts of these horizontal sections that rest on the support pegs 41 when the door is closed are lower than the rear ends of these sections, which are pivotally connected to the slide 26. If the rear horizontal sections 23 are substantially horizontal, the door will move straight out from the cabinet shell 11 until the slide reaches the support pegs 41 and the hinge bars can pivot into contact with the pivot pegs 42. If the rear sections of the hinge bars are inclined slightly, as shown in FIG. 2, the door will swing down gradually as the slide moves forward, as shown in FIG. 5. Inclined hinge bars that produce the type of motion shown in FIG. 5 are generally preferable.

FIG. 4 illustrates a preferred form of construction for this invention. The side walls of the cabinet shell 11 are produced of sheet metal 35 wrapped around a somewhat heavier insert plate 36, which may be of metal or plastic. The grooves 31 that support slides 26 are milled or molded in the insert plates 36. The support pegs 41 and pivot pegs 42 are bolted, welded or otherwise attached to the insert plate 36.

The hinge bars 20 may be stamped or cut from sheet metal quite easily, and the slide 26 may be of sheet metal or formed plastic. Thus, the hinge and support system of this invention is relatively inexpensive.

Since the door is stored beneath the cabinet shell in this invention, there is more effective storage space inside the cabinet than in typical prior art cabinets, which had to provide a certain amount of free space for storing the door. In the cabinets described above, the only free spaces required are the relatively insignificant space required at the top of the cabinet for the center portion of the slide (which in fact may be eliminated by using individual slides) and the small spaces at each side through which the hinge bars pivot. Thus, the hinge system of this invention provides more effective storage capacity than previous systems.

As may perhaps best be seen in FIG. 5, this invention also minimizes the room required in front of the cabinet to open the door. The only room required is the room needed to move the slide 26 forward to the support pegs 41. This distance may be significantly less than the heighth of the door. Thus, the cabinets of this invention can be positioned closer to the person using them, which is a distinct advantage in many applications, such as modern sit-down dentistry.

Of course, those skilled in the art will recognize many modifications that may be made in the cabinets described above within the scope of this invention, which is defined by the following claims.

We claim:

1. In a cabinet comprising top, bottom, side and rear walls and an open front, the bottom being supported above a floor surface so as to provide an open space beneath the bottom wall and a door for closing the open front, an improved hinge system for moving the door between a closed and an open position wherein the door in its open position is stored in the open space beneath the cabinet bottom wall, said hinge system comprising:

(a) horizontal runners along each side wall adjacent the top thereof and extending substantially front to rear in said cabinet;

(b) a slide supported in said runners, said slide being adjacent said back wall when said door is in its closed position and adjacent the front of said cabinet when said door is in its full open position;

(c) a hinge bar having a first end pivotally connected to said slide and a second end fixed to said door adjacent the top thereof, said hinge bar extending substantially horizontally from said slide when said door is in its closed position and depending substantially vertically from said slide when said door is in its open position; and (d) support means fixed to said side walls and providing substantially the sole support to maintain said hinge bar in a substantially horizontal orientation and said door in a closed position, said means being located at a point intermediate the ends of said hinge bar so as to become inoperative to support said bar in a horizontal orientation when said slide and the first end of said hinge bar are moved toward the open front of said cabinet and pass forward of said support means, thereby allowing said hinge bar to pivot downwardly to a substantially vertical position.

2. A cabinet as in claim 1 wherein said support means comprises a peg fixed to said side wall, said hinge bar resting on said peg and moving across said peg as said slide is moved towards the front of said cabinet to open said door.

3. A cabinet as set out in claim 1 wherein:

(a) said peg is spaced below and forward of the first end of said hinge bar so as to support said hinge bar with a slight downward slant from said first end to said peg; and (b) said hinge bar having its second end provided with an upwardly bent portion for attachment to the top of said door, said bent portion extending out through the open front of said cabinet when said hinge bar is in its vertical, door open position.

4. A hinge system according to claim 1 or 2 further comprising a pivot peg extending from the side of said cabinet in front of and below said support means, so that the hinge bar contacts the pivot peg and the door pivots about said pivot peg when said door is opened.

* * * * *